US011452327B2

(12) United States Patent
Deshpande et al.

(10) Patent No.: US 11,452,327 B2
(45) Date of Patent: Sep. 27, 2022

(54) SAFETY HELMET

(71) Applicant: Klein Tools, Inc., Lincolnshire, IL (US)

(72) Inventors: Shantanu Deshpande, Glenview, IL (US); Kingston Wong, Beach Park, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 187 days.

(21) Appl. No.: 16/246,935

(22) Filed: Jan. 14, 2019

(65) Prior Publication Data

US 2019/0231016 A1 Aug. 1, 2019

Related U.S. Application Data

(60) Provisional application No. 62/645,491, filed on Mar. 20, 2018, provisional application No. 62/622,472, filed on Jan. 26, 2018.

(51) Int. Cl.
*A42B 3/04* (2006.01)

(52) U.S. Cl.
CPC ..... *A42B 3/0446* (2013.01)

(58) Field of Classification Search
CPC ..... A42B 3/0446; A42B 3/044; A42B 3/042; A42B 3/0406; A42B 3/0426; A42B 3/30
USPC ..... 2/422
See application file for complete search history.

(56) References Cited

U.S. PATENT DOCUMENTS 1,947,786 A * 2/1934 Lueck ..... A42B 3/225 2/10
4,521,831 A * 6/1985 Thayer ..... A42B 3/044 2/422
5,026,016 A * 6/1991 Lisowski ..... F16B 21/09 248/225.11
5,688,039 A * 11/1997 Johnson ..... A42B 3/0446 362/106
6,497,493 B1 * 12/2002 Theisen ..... A42B 3/044 2/422
6,532,601 B1 * 3/2003 Berman ..... A42B 1/004 2/171
6,616,294 B1 * 9/2003 Henry ..... A42B 3/04 2/422
6,701,649 B1 * 3/2004 Brosi ..... A42B 3/0406 2/209.13
6,811,348 B1 * 11/2004 Meyer ..... F16M 11/041 403/325
8,060,951 B2 * 11/2011 Smith ..... A42B 3/065 2/411
9,702,534 B1 * 7/2017 Brion ..... A42B 1/244
(Continued)

FOREIGN PATENT DOCUMENTS

CA 2759794 A1 * 11/2010 ..... A42B 3/04
DE 102016115897 A1 * 3/2018 ..... H01M 50/209

*Primary Examiner* — Alissa L Hoey

(74) *Attorney, Agent, or Firm* — Leydig, Voit & Mayer, Ltd.

(57) ABSTRACT

A safety helmet includes an outer shell having a front receptacle disposed on a front side of the outer shell and a rear receptacle disposed on a rear side of the outer shell. A first accessory device having a first mating receptacle formed thereon is releasably mountable onto each of the front receptacle or the rear receptacle of the outer shell, and a second accessory device having a second mating receptacle formed thereon is releasably mountable onto each of the front receptacle or the rear receptacle of the outer shell.

17 Claims, 10 Drawing Sheets

(56) References Cited

U.S. PATENT DOCUMENTS 9,814,622 B2 * 11/2017 Sommers ..... A42B 3/06
9,872,531 B2 * 1/2018 Uke ..... A42B 3/04
10,743,599 B2 * 8/2020 Silva ..... G02B 6/0001
10,886,646 B2 * 1/2021 Goupil ..... H01R 33/94
11,019,870 B2 * 6/2021 Hyma ..... A42B 3/042
2002/0116749 A1 * 8/2002 Bielefeld ..... A42C 2/002 2/416
2008/0263752 A1 * 10/2008 Solinsky ..... A42B 3/042 2/422
2010/0083413 A1 * 4/2010 Mcgovern ..... A42B 3/04 2/6.6
2011/0072562 A1 * 3/2011 Prendergast ..... G02B 27/0176 2/422
2012/0224356 A1 * 9/2012 Fischer ..... A42B 3/0446 362/106
2012/0317706 A1 * 12/2012 Lebel ..... F41H 1/08 2/422
2012/0320569 A1 * 12/2012 Lu ..... A42B 3/044 362/106
2013/0086722 A1 * 4/2013 Teetzel ..... H02J 1/00 2/2.5
2014/0000013 A1 * 1/2014 Redpath ..... H05K 1/028 2/422
2014/0000014 A1 * 1/2014 Redpath ..... A42B 3/04 2/422
2014/0020159 A1 * 1/2014 Teetzel ..... A42B 3/04 2/422
2016/0242483 A1 * 8/2016 Dorsey ..... A42B 3/0406
2016/0249700 A1 * 9/2016 Zhavoronkov ..... A42B 3/042 2/421
2017/0238642 A1 * 8/2017 Tatum ..... A42B 3/044
2018/0128459 A1 * 5/2018 Carroll ..... F21V 21/08
2018/0192727 A1 * 7/2018 Chen ..... A42B 3/04
2018/0249779 A1 * 9/2018 DeLima ..... A42B 3/04
2019/0008228 A1 * 1/2019 Ramey ..... A42B 3/044
2019/0098952 A1 * 4/2019 Teetzel ..... A42B 3/04
2019/0101359 A1 * 4/2019 Zimmer ..... A42B 3/166
2019/0104797 A1 * 4/2019 Teetzel ..... F41H 1/04
2019/0107247 A1 * 4/2019 Teetzel ..... A42B 3/0406
2019/0350291 A1 * 11/2019 Maldonado ..... A42B 1/004
2019/0350292 A1 * 11/2019 Maldonado ..... F21L 4/08
2020/0170329 A1 * 6/2020 Bohn ..... A42B 3/16
2020/0268088 A1 * 8/2020 Sanchez ..... A42B 3/0406
2020/0329806 A1 * 10/2020 Wong ..... A42B 3/0406

* cited by examiner

SAFETY HELMET

CROSS-REFERENCE TO RELATED APPLICATIONS

This patent application claims the benefit of U.S. Provisional Patent Application No. 62/622,472, filed Jan. 26, 2018, and U.S. Provisional Patent Application No. 62/645,491, filed Mar. 20, 2018, each of which disclosure is incorporated herein by reference.

BACKGROUND OF THE DISCLOSURE

The present disclosure relates to personal protection devices and, more particularly, safety helmets for use to protect the wearer from falling objects. Such helmets are commonly also referred to as "hard hats." Various types of safety helmets are commonly used in in several industries, many of which include mounted personal illumination devices commonly called headlamps, typically powered by a direct current power source (either replaceable or rechargeable chemical cells). In the simplest of such devices, the headlamp is permanently mounted to the safety helmet in a fixed orientation at the front of the safety helmet. In other such devices, a mounting bracket is included at the front of the helmet to allow for a headlamp to be inserted.

One common method of mounting headlamps onto a safety helmet is by using an elastic band to conform and adhere to the exterior of the safety helmet, and then mounting the portable device onto the elastic band. While use of elastic bands can permit mounting of the headlamp at any orientation relative to the safety helmet, and also mounting of additional devices onto a single band, switching between orientations is difficult. Moreover, band-type mounting systems are prone to slipping off from the safety helmet, especially when lubricating fluids may fall on the helmet and enter the interface between the helmet's exterior and the band, thus requiring constant readjustment by the user.

Another common issue with known safety helmet headlamp arrangements is the connection of a power source to the headlamp. Portable power sources such as batteries are known to be heavy and bulky. When integrated with the headlamp, which is worn on the front facing side of the helmet, headlamps with integrated power sources tend to pull the helmet down, especially when the wearer is looking down. To reduce the weight of headlamps, manufacturers decrease the size of the batteries that are integrated therewith, which also decreases their useful life and will also decrease the lumen output of the headlamp. In certain applications where long life and higher light intensity is desired such as in underground mines, headlamps are typically connected to a power source via a wire, which leads to heavier and bulkier batteries worn around the user's waist. The wire leading to the batteries, however, can present a nuisance to the user and also increases the chances of unsafe conditions as it may become snagged as the user is moving around.

BRIEF SUMMARY OF THE DISCLOSURE

In one aspect, the present disclosure describes a safety helmet. The safety helmet includes an outer shell adapted to be worn by a user. The outer shell has a front side and a rear side, wherein the outer shell is reversible such that one of the front side or the rear side is oriented above a face of the user when the outer shell is worn by the user. A front receptacle is disposed on the front side of the outer shell, and a rear receptacle is disposed on the rear side of the outer shell. The front receptacle and the rear receptacle are of identical construction. An accessory device has a mating receptacle formed thereon, and is releasably mountable onto each of the front receptacle and the rear receptacle of the outer shell.

In another aspect, the disclosure describes a safety helmet, which includes an outer shell adapted to be worn by a user. The outer shell has a front side and a rear side. The outer shell is reversible such that one of the front side or the rear side is oriented above a face of the user when the outer shell is worn by the user. A front receptacle is disposed on the front side of the outer shell, and a rear receptacle is disposed on the rear side of the outer shell. A first accessory device has a first mating receptacle formed thereon and is releasably mountable onto each of the front receptacle or the rear receptacle of the outer shell, and a second accessory device has a second mating receptacle formed thereon and is releasably mountable onto each of the front receptacle or the rear receptacle of the outer shell.

In yet another aspect, the disclosure describes a safety helmet that includes an outer shell adapted to be worn by a user and having a front side and a rear side. The outer shell is reversible such that one of the front side or the rear side is oriented above a face of the user when the outer shell is worn by the user. The safety helmet further includes a front receptacle disposed on the front side of the outer shell, and a rear receptacle disposed on the rear side of the outer shell. The front receptacle includes a front set of terminals associated therewith, the rear receptacle includes a rear set of terminals associated therewith, and a set of conductors is connected between the front set of terminals and the rear set of terminals.

In yet another aspect, the disclosure describes a method for using a protective device. The method includes providing an outer shell adapted to be worn by a user, the outer shell having a front side and a rear side, wherein the outer shell is reversible such that the front side or the rear side is oriented above a face of the user when the user wears the outer shell. The method further includes providing a front receptacle disposed on the front side of the outer shell, and providing a rear receptacle disposed on the rear side of the outer shell. The method also includes releasably attaching an accessory device having a mating receptacle formed thereon into one of the front or rear receptacle, detaching the accessory device, and reattaching the accessory device into another one of the front or rear receptacle.

DETAILED DESCRIPTION OF A PREFERRED EMBODIMENT

The present invention relates to the field of personal protection devices and, more particularly, safety helmets. The safety helmets in accordance with the disclosure include two mounts, one on either the front or back facing sides of the helmet, which permit connection of removable modules onto the helmet such as headlamps, cameras, speakers, larger capacity batteries, cellphones, and the like. In one embodiment, the helmet includes an integrated, non-removable power source and integrated electrical leads or conductors to a port for a removable device. In this way, the removable device such as a headlamp can be made lighter without sacrificing battery power output or electrical potential. The headlamp, which may include its own power source that is chargeable by the helmet, may be removed and used as a flashlight before being replaced onto the helmet for charging.

Figure 1:
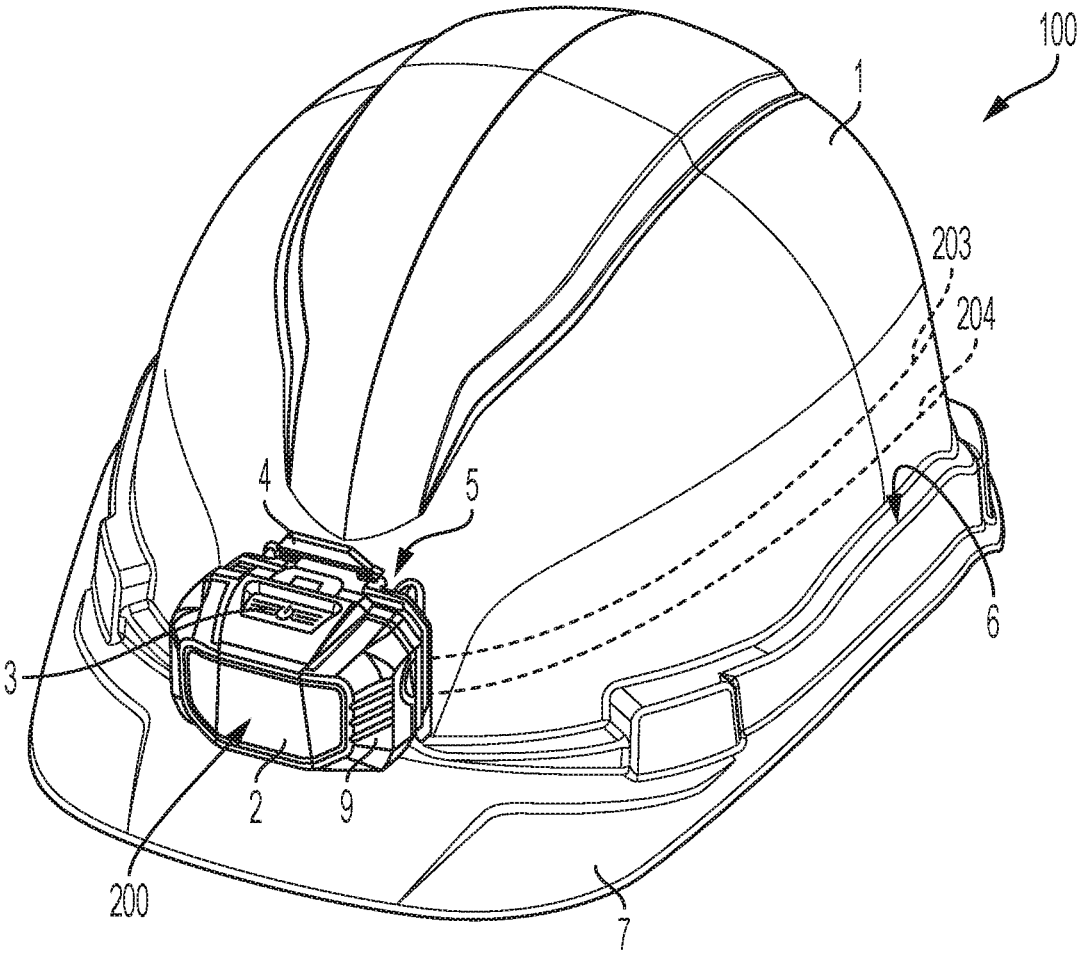
FIGS. 1 and 2 are front and rear perspective views of a safety helmet in accordance with the disclosure.

A safety helmet 100 in accordance with one embodiment of the present disclosure is shown in FIG. 1. The safety helmet 100 includes a detachably mounted, headlamp device 200. The safety helmet 100 includes a hard outer shell 1 designed to protect the head of the wearer from injury and a brim 7 designed to shield the user's eyes from sunlight or falling debris. Accessory slots 6 may be present to accept various accessories. The headlamp device 200 features a headlamp body 9, a light source 2, a power switch 3 to activate the light source 2, and a mounting bracket 4 to removeably attach the headlamp device 200 to the safety helmet 100.

Connection of the headlamp device 200, which is shown as one exemplary embodiment of a device that can be connected to the safety helmet 100, is accomplished by releasable engagement of the mounting bracket 4 to a front tapered receiver slot 5 of the safety helmet 100. The front tapered receiver slot 5 is disposed on the front of hard outer shell 1 of the safety helmet 100. In this configuration, the light emanating from the light source 2 projects forward from the safety helmet 100, illuminating the area in front of a user when the safety helmet is in its standard orientation in which the brim 7 is disposed over the wearer's face.

Figure 3:
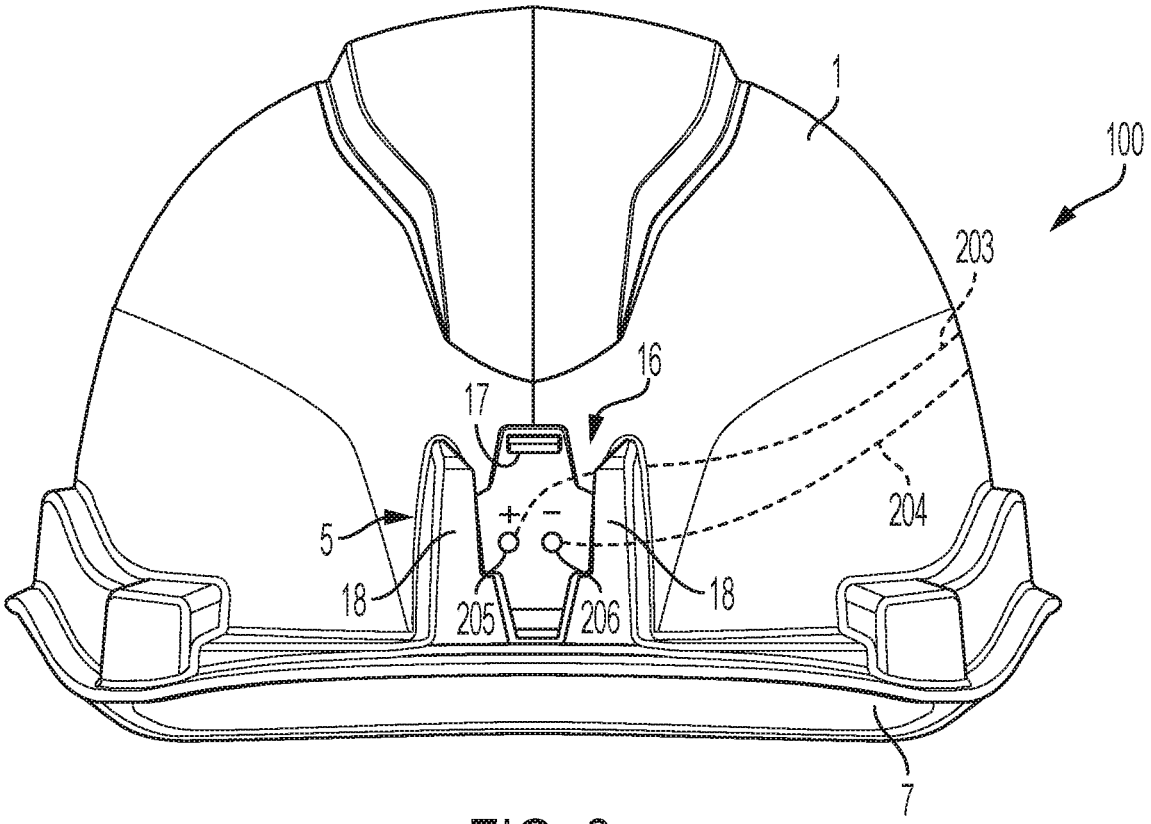
FIG. 3 is a front view of the safety helmet of FIG. 1.
Figure 4:
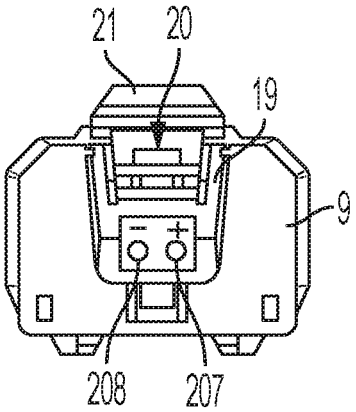
FIG. 4 is a rear view of a device that is connectable to the safety helmet of FIG. 1 in accordance with the disclosure.

The mounting bracket 4 and front tapered receiver slot 5 are one exemplary embodiment for releasably connecting the device 200 to the safety helmet 100. As also shown in FIGS. 3 and 4, the front tapered receiver slot 5 includes a tapered channel 16 formed between a pair of raised sidewalls 18 and a stop, shown in the preferred embodiment as a protruding nub 17 extending from the surface of the hard outer shell 1 of the safety helmet 100. The mounting bracket 4 is in the form of a tapered clip 19 conforming to the tapered channel 16 such that it is retained by the raised sidewalls 18 when it is inserted into the tapered channel. A slot 20 in the tapered clip 19 receives the protruding nub 17 on the hard outer shell 1 of the safety helmet 100 locking it into place. The mounting bracket 4 can be detached from the front tapered receiver slot 5 by pulling on a release lever 21 of the tapered clip 19, which disengages the protruding nub 17 from the slot 20 to allow the headlamp device 200 to be lifted out of the tapered channel 16.

Figure 2:
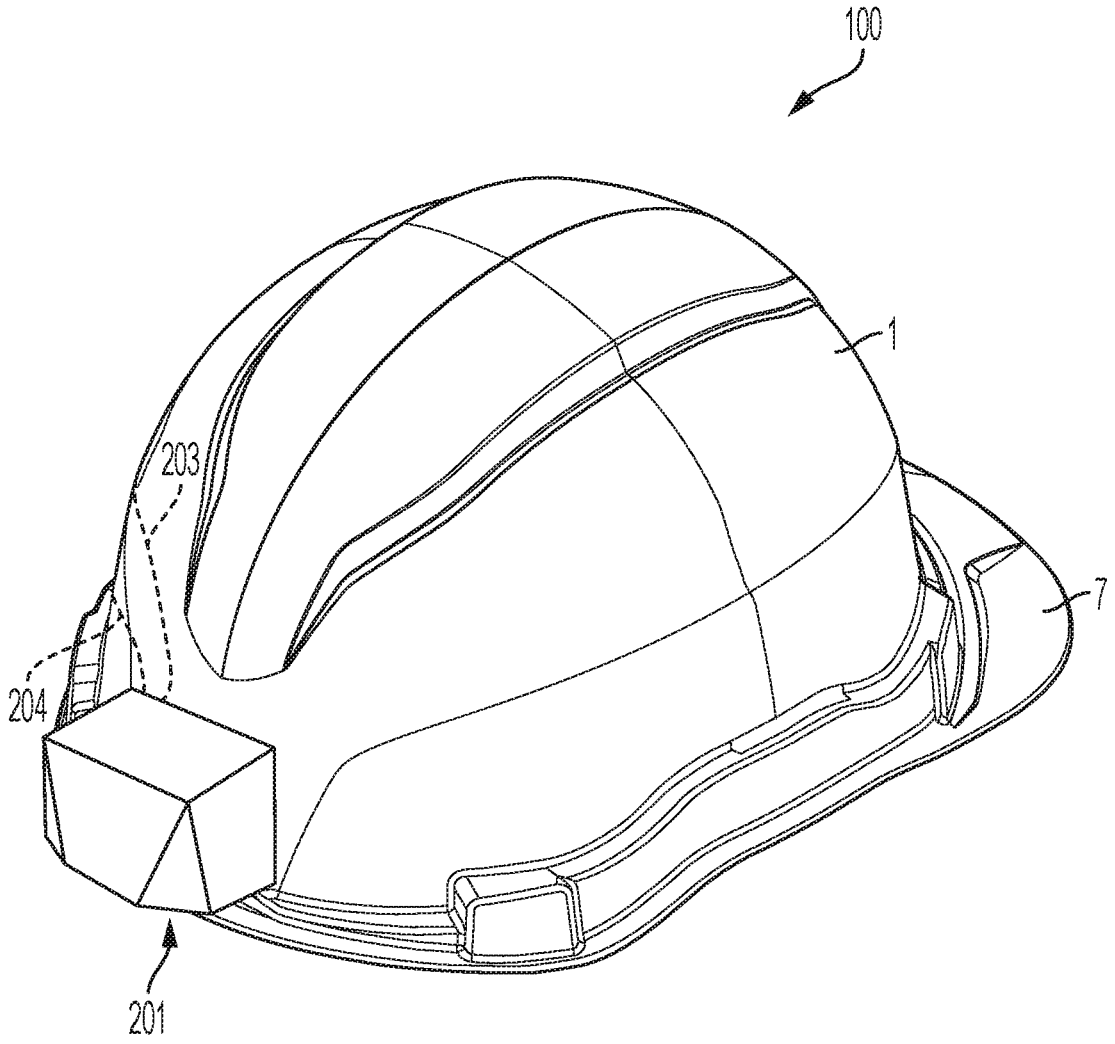

The safety helmet 100 is shown from a rear perspective in FIG. 2. As shown, the safety helmet 100 includes a second device 201 mounted on the rear side of the hard outer shell 1. While in certain embodiments the second device 201 may be releasably mounted to the safety helmet 100 using a second tapered receiver slot, similar to the front tapered receiver slot 5 on the front of the helmet (FIG. 1), in the illustrated embodiment of FIG. 2, the second device 201 is non-releasably or, generally permanently, mounted onto the safety helmet 100. The second device shown in FIG. 2 is a battery pack or power storage device that houses disposable or rechargeable battery power cells. The battery cells in the second device 201 are configured to provide electrical potential in the form of a direct current (DC) electrical power output into two conductors, 203 and 204 (shown in FIG. 1), which are integrated into the hard outer shell 1. As shown in FIGS. 7 and 9-13 in two alternative embodiments, the safety helmet 100 includes a rear tapered slot 11 that is substantially identical to the front tapered receiver slot 5.

The conductors 203 and 204, which are shown in dashed lines in FIGS. 1 and 2, are metal conductors that can be made from copper, aluminum, steel, zinc or the like, and are molded into the thermoplastic material of the hard outer shell 1 of the safety helmet 100. In one embodiment, the conductors can be placed into a mold used for injection molding of the hard outer shell 1 such that the plastic used to construct the hard outer shell 1 can be over-molded around the conductors to conceal and protect the conductors as shown, for example, in FIG. 6. Placement of the conductors can be selected depending on the particular safety requirements of the helmet. As shown, the conductors are placed along an outer region of the helmet, away from the wearer's head.

At one end, the conductors 203 and 204 are permanently and electrically connected to two poles of the battery cells in the second device 201 such that an electrical potential created by the battery cells is available through the conductors. At another end the conductors 203 and 204 terminate at terminals 205 and 206, as shown in FIG. 3, which present bare surfaces for achieving a releasable electrical connection with corresponding terminals 207 and 208 formed on the back side of the device 200 that is connectable to the front tapered receiver slot 5, as shown in FIG. 4. In this way, when the device 200 is mechanically connected to the receiver slot, an electrical connection between the first device, for example, the headlamp device 200 and the second device 201 is also established and maintained while the device 200 is mounted onto the safety helmet 100.

Figure 5:
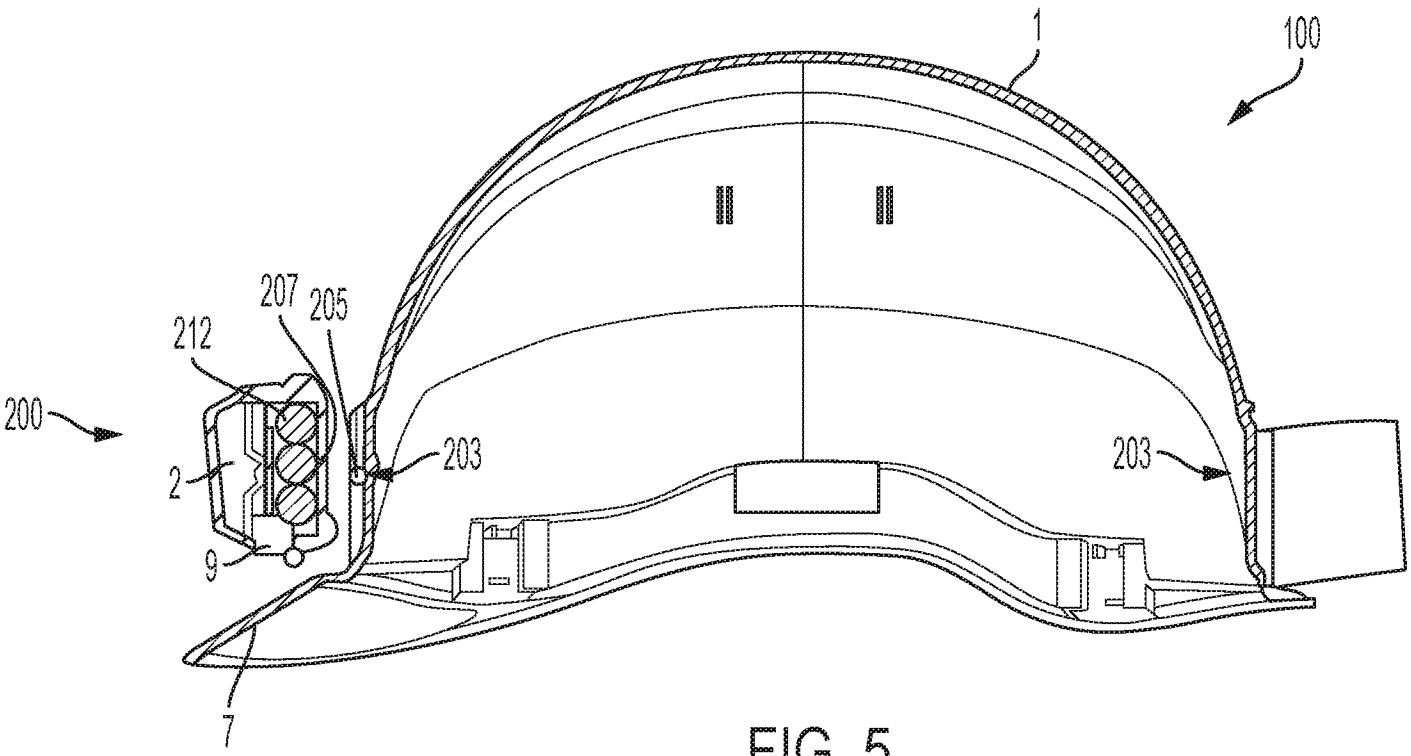
FIG. 5 is a cross section of the safety helmet of FIG. 1.
Figure 6:
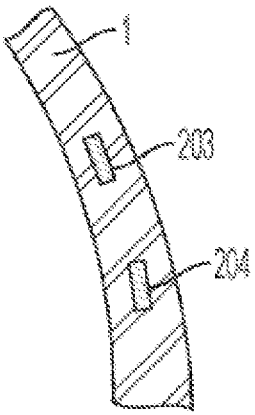
FIG. 6 is an enlarged detail cross section of the helmet of FIG. 1.

FIG. 5 a side, section view through the safety helmet 100 shown in FIG. 1, and FIG. 6 is an enlarged detail view to illustrate the connections of the electrical conductors through the material of the hard outer shell 1 to the terminals 207 and 208 (only one visible) and also to the additional device 201. Also visible here are secondary, rechargeable batteries 212 used within the device 200, which can be charged through the conductors from the second device 201 and which also allow the device 200 to be used autonomously, if desired. In the embodiment shown, the rechargeable batteries 212 used in the device 200 have a smaller electrical capacity than batteries in the second device 201 to allow the device to be recharged while connected to the safety helmet 100, provided that the electrical potential of the second device 201 is higher than the device 200 and charging of the device 200 can occur. The recharging of the device 200 advantageously permits use of the device to be used autonomously when separated from the safety helmet 100, and then reconnected to the helmet for charging from the second device 201. While charging, the device 200 can also operate, for example, to provide light, by drawing sufficient electrical power from the second device to both operate and charge the device 200 because of the larger electrical capacity of the second device 201. When the second device 201 is connected to a power source for charging, and while the device 201 is connected, both devices can be charged simultaneously to increase to the total charge available on the safety helmet 100. Moreover, the second device 201 can include a shutoff or diode integrated therewith, which only permits flow of electrical power in the form of electrical DC current from the second device 201 to the device 200, but not in the opposite direction.

The devices 200 and 201 may be embodied as various types of devices or accessories. For example, in addition to headlamps or battery packs, the devices may be embodied as a speaker, which can be connected to an audio player or similar device by known methods, a holder or bracket for another device such as a camera, smartphone or the like, a blinking or otherwise illuminated light that marks the location of the user, a GPS receiver or tag, and the like.

Figure 7:
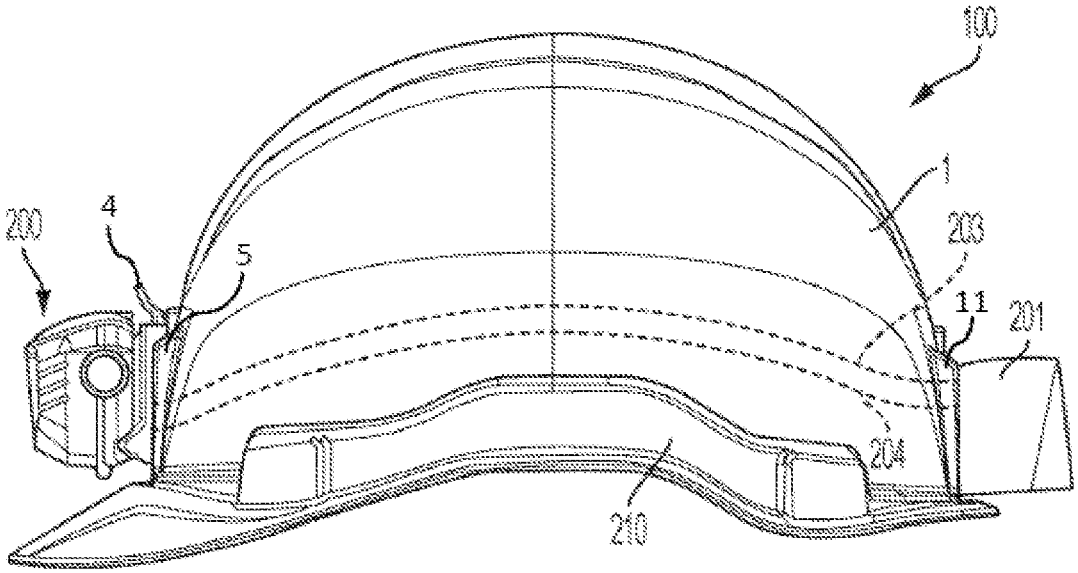
FIG. 7 is a side view of an alternative embodiment.

A first alternative embodiment is shown in FIG. 7, in which a plurality of electrical devices, in this case, illumination devices 210, are integrated around the helmet and connected to be powered by the second device 201. For example, the illumination devices 210 may be low-powered LED lights or strobes that can be illuminated and used as safety devices, in addition to reflective devices, in low light environments. The electrical connections to power the illumination devices 210 can be integrated into the hard outer shell in a fashion similar to the conductors 203 and 204, and be electrically connected therewith. A headlamp device 200 is shown mounted via the mounting bracket 4 to the front tapered receiver slot 5 formed by the hard outer shell 1". The second headlamp device 201 is mounted to a rear tapered receiver slot 11 formed by the hard outer shell 1". In this embodiment, the front tapered receiver slot 5 is substantially identical to the rear tapered receiver slot 1".

Figure 8:
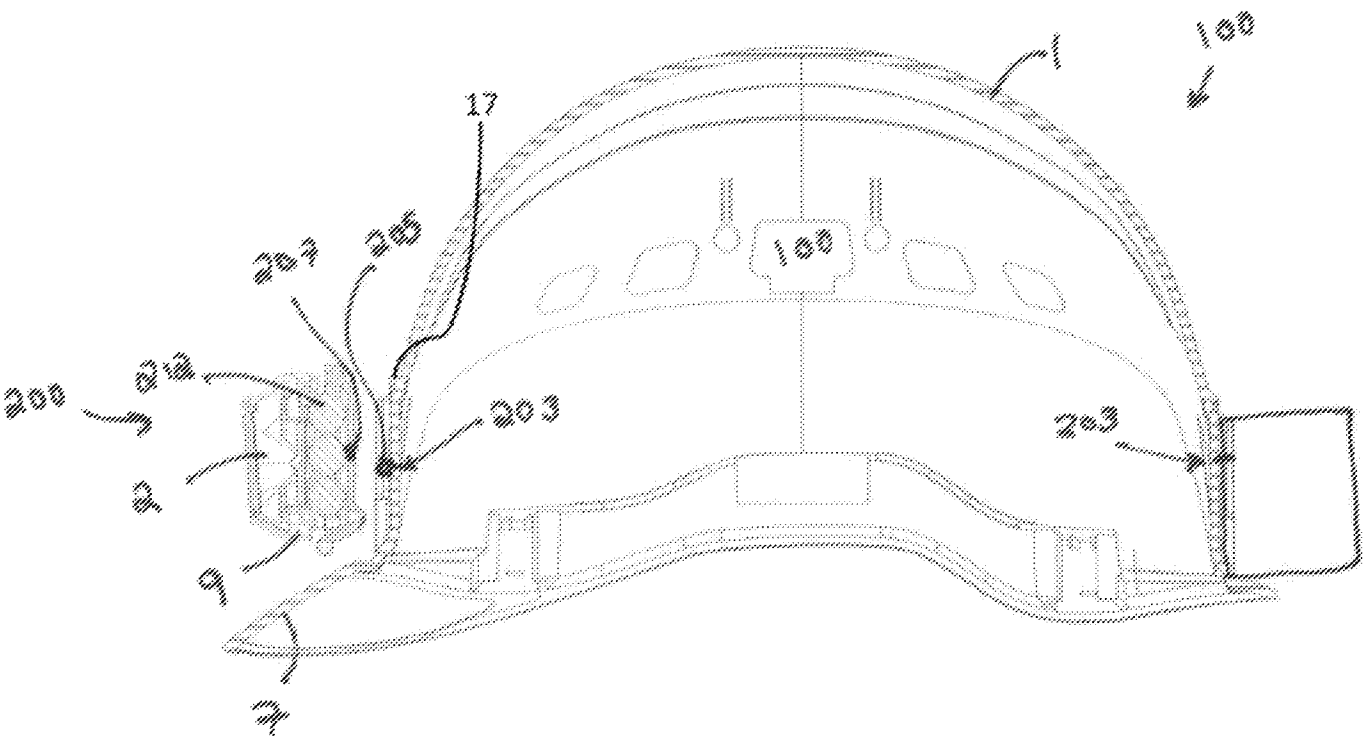
FIG. 8 is a cross section of the safety helmet of FIG. 1 in an alternate configuration.

FIG. 8 shows a cross section view through the safety helmet 100 shown in FIG. 1 in an alternate configuration. FIG. 8 shows the safety helmet 100 including the detachably mounted headlamp device 200. The headlamp device 200 includes the light source 2, the headlamp body 9, and the rechargeable batteries 212. The conductors 203 are shown integrated into the outer shell 1' and terminating at the terminal 205. The headlamp device 200 includes the terminal 207 for releasable electrical connection with terminal 205. The safety helmet 100 of FIG. 8 shows that the protruding nub 17 and the brim 7 are unitary features of the hard outer shell 1'. Stated in other words, the outer shell forms or defines the protruding nub 17 and the brim, which are integrally molded with the outer shell from a common material such as plastic. The venting holes 8 may be present for ventilation of the interior of the safety helmet 100. As shown in FIG. 3, the protruding nub 17 is centrally disposed relative to the external slot. In the illustrated embodiment of FIG. 3, the protruding nub 17 is disposed at an upward location away from the brim 7.

Figure 9:
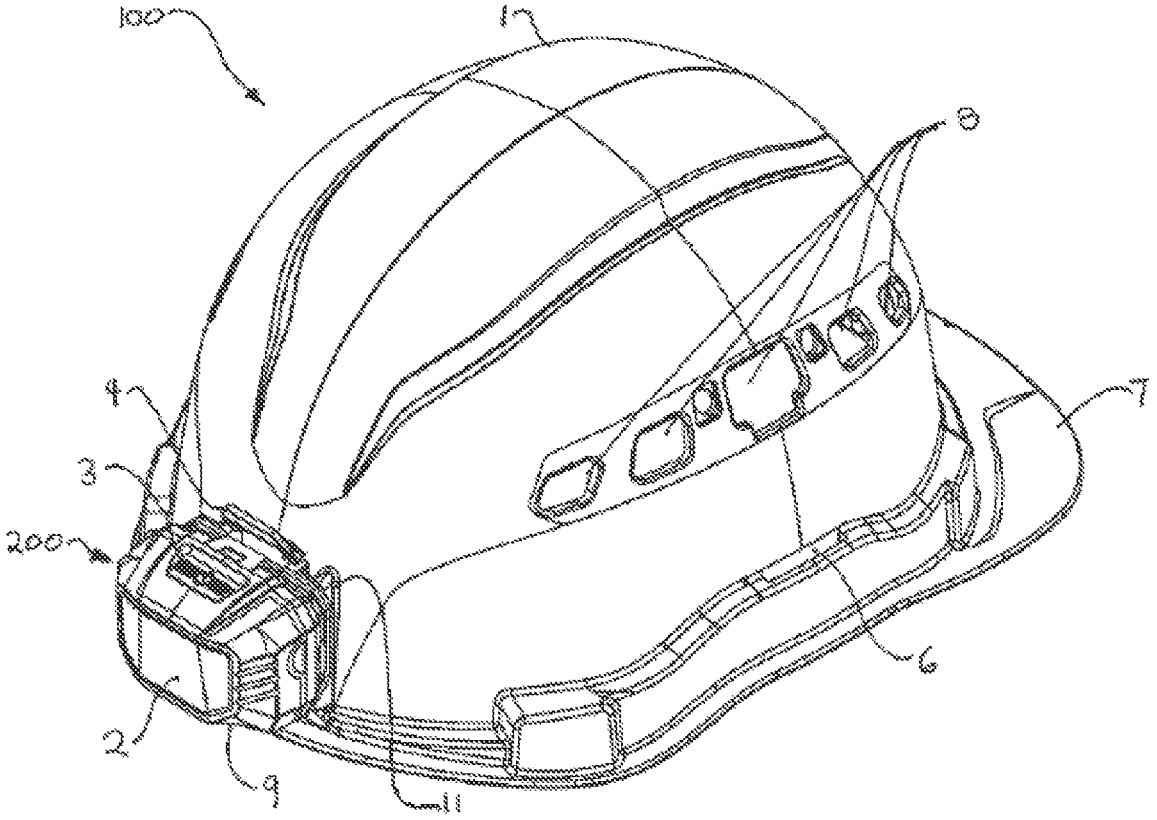
FIG. 9 is a rear top right perspective view of the safety helmet of FIG. 1 in another configuration wherein an electronic device is releasably mounted on the rear of the safety helmet.

FIG. 9 shows a rear top right perspective view of the safety helmet 100 of FIG. 1 in an alternate configuration. The safety helmet features a detachable mounted headlamp device 200 mounted via the mounting bracket 4 in a rear tapered receiver slot 11 substantially identical to the front tapered receiver slot 5 disposed on the hard outer shell 1' of the safety helmet 100. In this configuration, the light emanating from the light source 2 projects rearward of the safety helmet 100, illuminating the area in front of a user when the safety helmet is in its reverse orientation, with the brim 7 behind the wearer's head.

Figure 10:
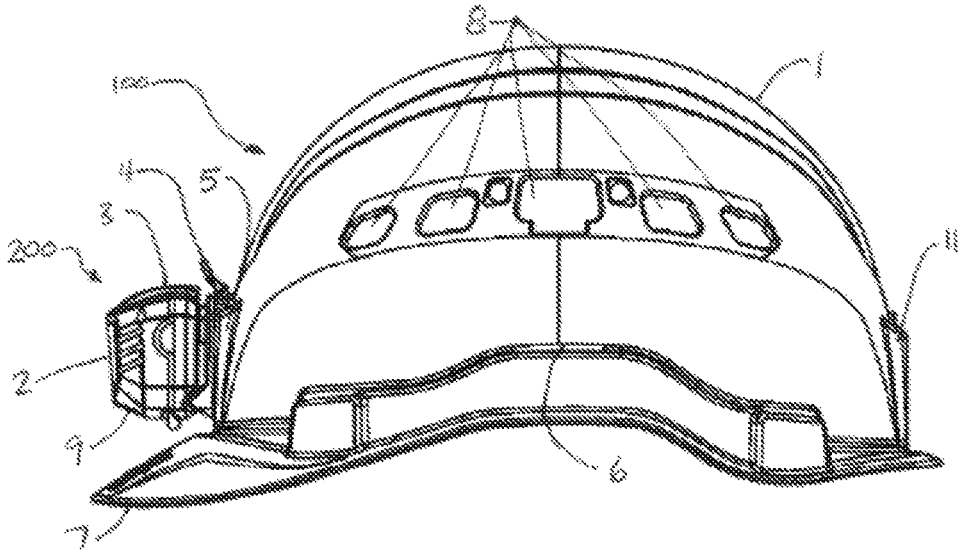
FIG. 10 is a left side view of the safety helmet shown in FIG. 9 in yet another configuration wherein the electronic device is releasably mounted on the front of the safety helmet.

FIG. 10 depicts a side view of the safety helmet 100 of FIG. 9, featuring the detachable mounted headlamp device 200 mounted via the mounting bracket 4 in the front tapered receiver slot 5 of the hard outer shell 1' of the safety helmet 100. In this configuration, the light emanating from the light source 2 projects forward of the safety helmet 100, illuminating the area in front of a user when the safety helmet is in its reverse orientation, with the brim 7 above the wearer's face. The rear tapered receiver slot 11 can be seen in this view, disposed on the hard outer shell 1' opposite from the front tapered receiver slot 5.

Figure 11:
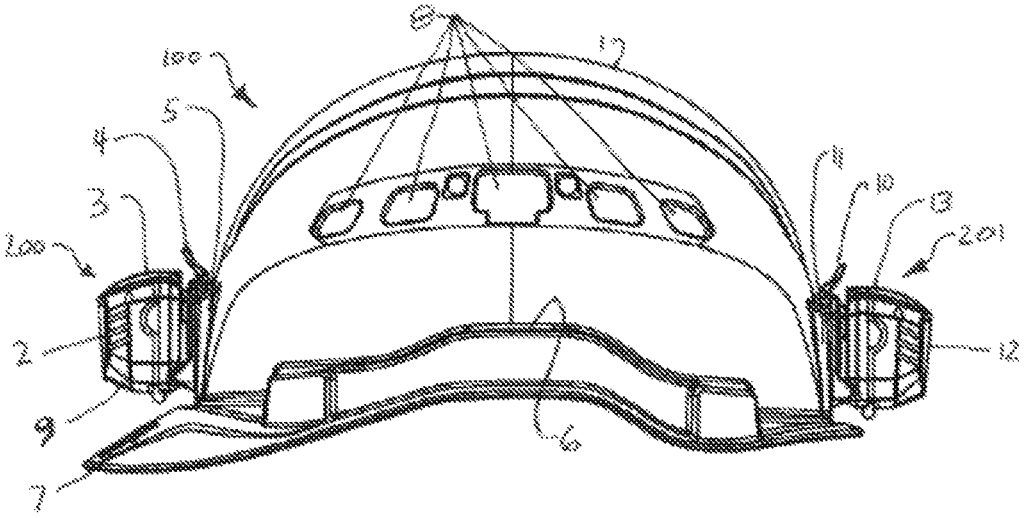
FIG. 11 is a left side view of the safety helmet shown in FIG. 9 in an alternate configuration wherein one of the electronic devices is releasably mounted on the front of the safety helmet and another of the electronic devices is releasably mounted on the rear of the helmet.

FIG. 11 depicts a side view of the safety helmet 100 of FIG. 9 with the front tapered receiver slot 5 and the rear tapered receiver slot 11 oppositely formed by the hard outer shell 1' of the safety helmet 100. In this view, a second headlamp device 201 is mounted via a second mounting bracket 10 to the rear tapered receiver slot 11, while the headlamp device 200 is mounted via the mounting bracket 4 to the front tapered receiver slot 5. In this configuration of the safety helmet 100, the headlamp device 200 and second headlamp device 201 can be used in various ways. Both the headlamp device 200 and the second headlamp device 201 could be powered on, such that the light source 2 illuminates the area in front of the user and a second light source 12 illuminates the area behind the user's head while the cap is in its standard orientation. Alternately, the light source 2 on the headlamp device 200 might be powered on illuminating the area in front of the user while the safety helmet 100 is in its standard orientation, with the brim 7 above the user's face, and if the user chooses to move the helmet to its reverse orientation, with the brim 7 behind the user's face, the light source 2 could be powered down by means of pressing the power switch 3 and the second light source 12 powered on by pushing the second power switch 13 on the second headlamp device 201, such that the second light source 12 illuminates the area in front of the user. The user might also store the second headlamp device 201 on the rear tapered receiver slot 11 as a backup to the headlamp device 200 on the front tapered receiver slot 11, switching the position of the headlamp device 200 and second headlamp device 201 as necessary, for example, to address a malfunction or low battery state of the headlamp device 200. If the headlamp device 200 and the second headlamp device 201 have a high and low setting for the light source 2 and the second light source 12, a user can quickly configure the safety helmet 100 such that in the standard orientation the light source 2 provides bright illumination while the second light source 12 provides only low brightness to allow for signaling and location of the wearer, and may be converted when in reverse orientation such that the second light source 12 provides bright illumination while the light source 2 provides only low brightness to allow for signaling and location of the wearer, without having to remove or reposition either the headlamp device 200 or the second headlamp device 201.

Figure 12:
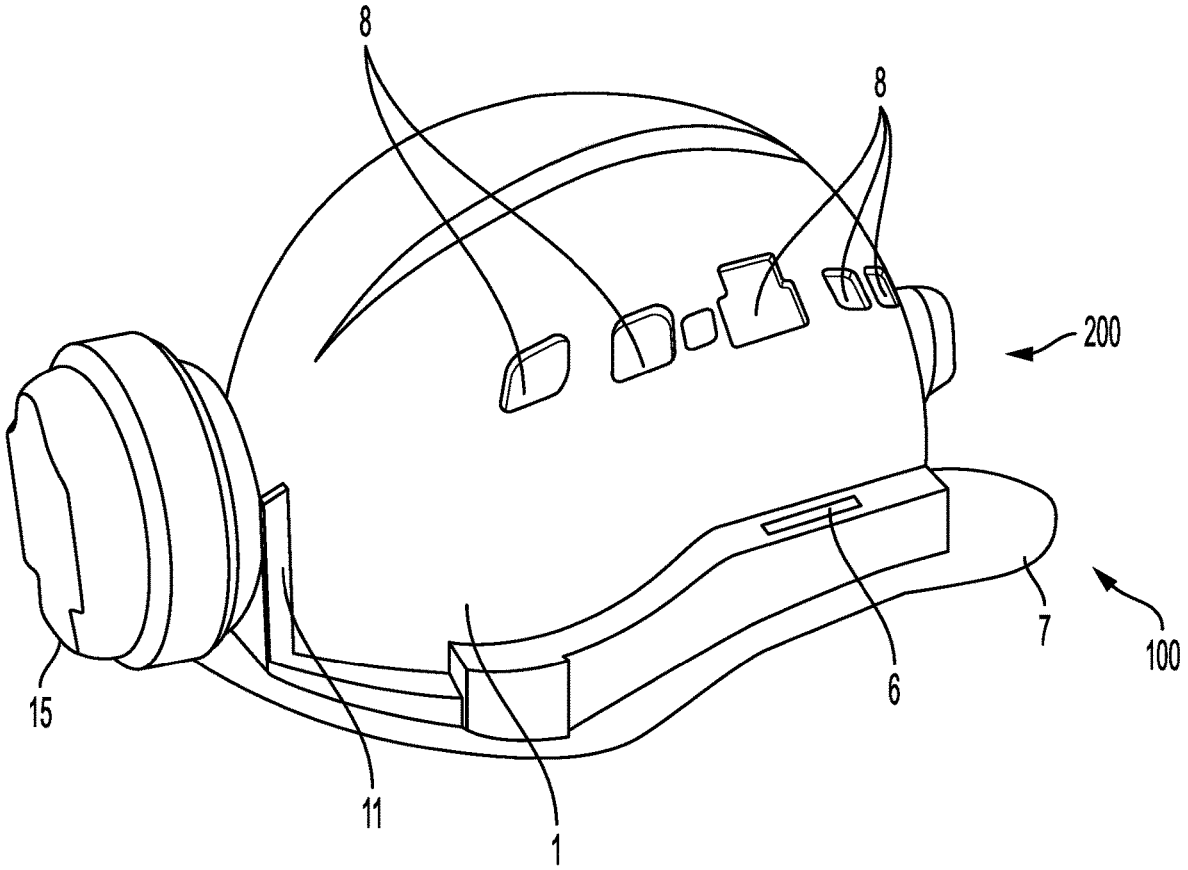
FIG. 12 is a rear to right perspective view of the safety helmet shown in FIG. 9 in yet another alternate configuration wherein the electronic device is releasably mounted on the front of the safety helmet and a different type of electronic device is releasably mounted on the rear of the safety helmet.
Figure 13:
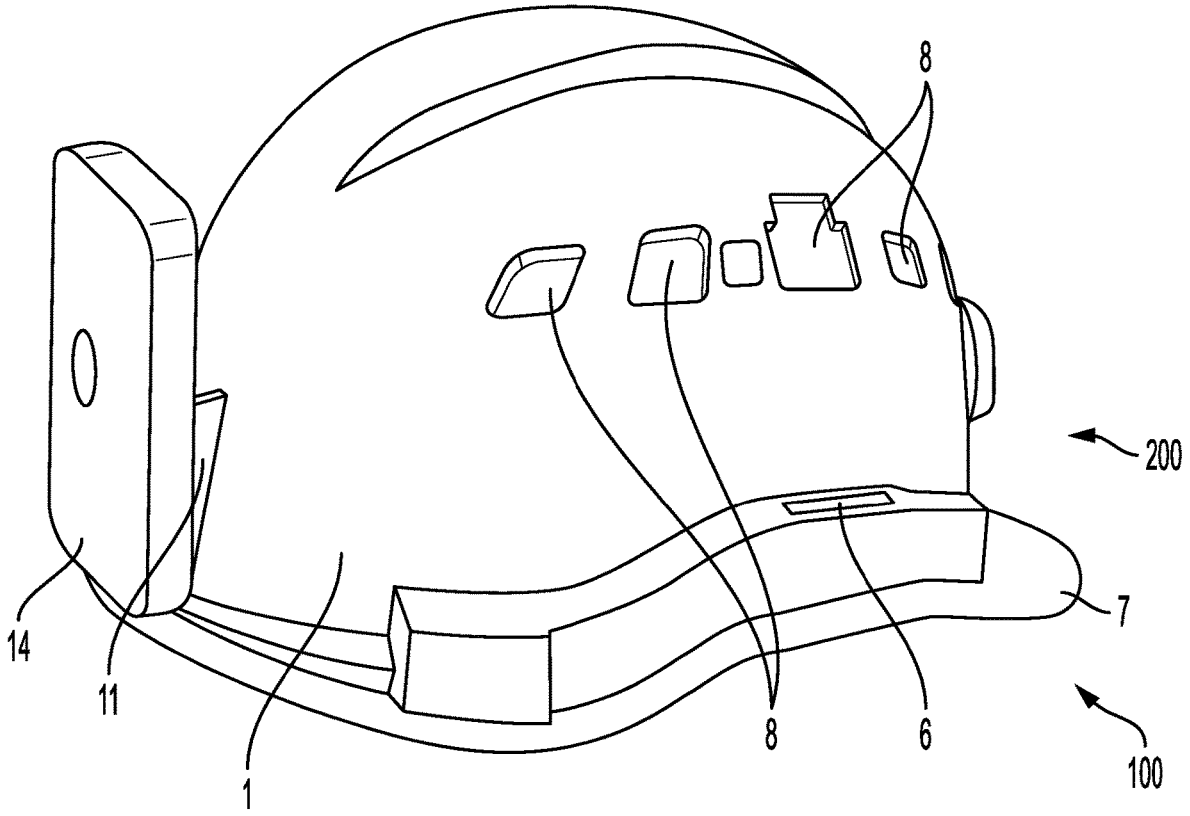
FIG. 13 is a is a rear to right perspective view of the embodiment shown in FIG. 9 in another alternate configuration wherein the electronic device is releasably mounted on the front of the safety helmet and another type of electronic device is releasably mounted on the rear of the safety helmet.

FIG. 12 shows the safety helmet 100 in a configuration with a speaker device 15 mounted to the receiver slot 11 and the headlamp device 200 mounted to the receiver slot 5. FIG. 13 shows the safety helmet 100 in another configuration with a battery pack 14 mounted to the receiver slot 11 and the headlamp device 200 mounted to the receiver slot 5. As shown in FIGS. 12 and 13, the accessory slot(s) 6, the brim 7, the venting holes 8, and the receiver slot 11 are unitary features of the outer shell 1'. In other words, the outer shell 1' forms or defines the accessory slot(s) 6, the brim 7, the venting holes 8, and the receiver slot 11. The accessory slot(s) 6 are configured to accept various accessories. As shown in FIGS. 12 and 13, the accessory slot(s) 6 are integrated with the outer shell 1'. As shown in FIGS. 12 and 13, the brim 7 is integrated with the outer shell 1. As shown in FIGS. 12 and 13, the venting holes 8 are integrated with the outer shell 1'. As shown in FIGS. 12 and 13, the receiver slot 11 is integrated with the outer shell 1'.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A safety helmet, comprising:

an outer shell adapted to be worn by a user, the outer shell being molded from a common material and having an exterior surface defining a front side, a rear side, and a brim extending forward from the front side and configured to shield the user's eyes from sunlight or falling debris, wherein the outer shell is reversible such that one of the front side or the rear side is oriented above a face of the user when the outer shell is worn by the user, and wherein the brim is configured to be disposed above the face of the user when the outer shell is worn by the user with the front side being oriented above the face of the user;

a front receptacle having an external slot extending upwardly along the front side on the exterior surface of the outer shell above the brim and a protruding nub, wherein the protruding nub is integrally molded with the outer shell from the common material and is disposed centrally relative to the external slot and directly onto the exterior surface of the outer shell at an upward location away from the brim;

a rear receptacle having an additional external slot disposed on the rear side on the exterior surface of the outer shell, wherein the front receptacle and the rear receptacle are of identical construction; and an accessory device having a mating receptacle formed thereon, at least a portion of the mating receptacle being selectively engageable within each of the external slot of the front receptacle or the additional external slot of the rear receptacle such that the accessory device is releasably mountable onto each of the front receptacle and the rear receptacle on the exterior surface of the outer shell.

2. The safety helmet of claim 1, wherein the external slot of the front receptacle is a receiver slot flanked by raised walls and the protruding nub comprises a stop, wherein the accessory device includes a clip, and wherein the receiver slot aligns the accessory device therein, the raised walls retain the accessory device therebetween, and the stop engages the clip to releasably mount the accessory device in the front receptacle.

3. The safety helmet of claim 1, wherein the common material is plastic.

4. The safety helmet of claim 1, wherein the accessory device includes a clip, the external slot aligns the accessory device therein, and the protruding nub engages the clip to releasably mount the accessory device in the front receptacle.

5. The safety helmet of claim 1, wherein the external slot of the front receptacle is configured to receive a portion of the accessory device to mount the accessory device to the front receptacle.

6. The safety helmet of claim 1, wherein:

the front receptacle includes a first sidewall;

the accessory device includes a bracket; and the bracket is retained by the first sidewall to mount the accessory device to the front receptacle.

7. The safety helmet of claim 6, wherein:

the front receptacle includes a second sidewall; and the bracket is retained by the first sidewall and the second sidewall.

8. A safety helmet, comprising:

an outer shell adapted to be worn by a user, the outer shell being molded from a common material and having an exterior surface defining a front side, a rear side, and a brim extending forward from the front side and configured to shield the user's eyes from sunlight or falling debris, wherein the outer shell is reversible such that one of the front side or the rear side is oriented above a face of the user when the outer shell is worn by the user, and wherein the brim is configured to be disposed above the face of the user when the outer shell is worn by the user with the front side being oriented above the face of the user;

a front receptacle being integrally molded with the outer shell and having an external slot extending upwardly along the front side on the exterior surface of the outer shell above the brim and a protruding nub, wherein the protruding nub is integrally molded with the outer shell from the common material and is disposed centrally relative to the external slot and directly onto the exterior surface of the outer shell;

a rear receptacle having an additional external slot disposed on the rear side on the exterior of the outer shell;

a first accessory device having a first mating receptacle formed thereon, at least a portion of the first accessory device being releasably mountable onto each of the front receptacle or the rear receptacle on the exterior of the outer shell; and a second accessory device having a second mating receptacle formed thereon, at least a portion of the second accessory device being releasably mountable onto each of the front receptacle or the rear receptacle on the exterior of the outer shell.

9. The safety helmet of claim 8, wherein the external slot of the front receptacle includes a receiver slot flanked by raised walls and including a stop, wherein the first accessory device includes a clip, and wherein the receiver slot aligns the first accessory device therein, the raised walls retain the first accessory device therebetween, and the stop engages the clip to releasably mount the first accessory device in the front receptacle.

10. The safety helmet of claim 8, wherein the common material is a molded plastic material.

11. The safety helmet of claim 8, where in the front receptacle and the rear receptacle are of identical construction.

12. The safety helmet of claim 8, wherein the external slot of the front receptacle includes a receiver slot flanked by raised walls and including a protruding nub, wherein the first accessory device includes a clip, and wherein the receiver slot aligns the first accessory device therein, the raised walls retain the first accessory device therebetween, and the protruding nub engages the clip to releasably mount the first accessory device in the front receptacle.

13. The safety helmet of claim 8, wherein the external slot of the front receptacle is configured to receive a portion of the first accessory device to mount the first accessory device to the front receptacle.

14. The safety helmet of claim 8, wherein:

the front receptacle includes a first sidewall;

the first accessory device includes a bracket; and the bracket is retained by the first sidewall to mount the first accessory device to the front receptacle.

15. The safety helmet of claim 14, wherein:

the front receptacle includes a second sidewall; and the bracket is retained by the first sidewall and the second sidewall.

16. A safety helmet, comprising:

an outer shell adapted to be worn by a user, an exterior of the outer shell having a front side, a rear side, and a brim extending outwardly from the front side and configured to shield the user's eyes from sunlight or falling debris;

a front receptacle having an external slot extending upwardly on the front side along the exterior of the outer shell above the brim and a protruding nub, wherein the outer shell forms the protruding nub from a same material as the outer shell;

a rear receptacle having an additional external slot disposed on the rear side on the exterior of the outer shell, wherein the front receptacle and the rear receptacle are of identical construction; and an accessory device having a mating receptacle formed thereon, at least a portion of the mating receptacle being selectively engageable within each of the external slot of the front receptacle or the additional external slot of the rear receptacle such that the accessory device is releasably mountable onto each of the front receptacle and the rear receptacle on the exterior of the outer shell.

17. A safety helmet, comprising:

an outer shell adapted to be worn by a user, an exterior of the outer shell having a front side, a rear side, and a brim extending outwardly from the front side and configured to shield the user's eyes from sunlight or falling debris;

a front receptacle having an external slot extending upwardly on the front side and a protruding nub disposed centrally relative to the external slot, the protruding nub being integrally molded with the outer shell on the exterior from a common material;

a rear receptacle having an additional external slot disposed on the rear side on the exterior of the outer shell, the rear receptacle having an additional protruding nub disposed centrally relative to the additional external slot, the additional protruding nub being integrally molded with the outer shell on the exterior from the common material;

a first accessory device having a first mating receptacle formed thereon, at least a portion of the first accessory device being releasably mountable onto each of the front receptacle or the rear receptacle on the exterior of the outer shell; and a second accessory device having a second mating receptacle formed thereon, at least a portion of the second accessory device being releasably mountable onto each of the front receptacle or the rear receptacle on the exterior of the outer shell;

wherein the brim, the front receptacle, and the rear receptacle are a unitary feature of the outer shell.

* * * * *